US010265557B2

(12) United States Patent
Volk et al.

(10) Patent No.: US 10,265,557 B2
(45) Date of Patent: Apr. 23, 2019

(54) FIRE FIGHTING SYSTEM FOR A RAILWAY VEHICLE

(75) Inventors: Andreas Volk, Köln (DE); Roger Dirksmeier, Menden (DE)

(73) Assignee: FOGTEC Brandschutz GmbH & Co. KG, Köln (DE)

( * ) Notice: Subject to any disclaimer, the term of this patent is extended or adjusted under 35 U.S.C. 154(b) by 1745 days.

(21) Appl. No.: 13/510,314

(22) PCT Filed: Oct. 21, 2010

(86) PCT No.: PCT/EP2010/065868
§ 371 (c)(1),
(2), (4) Date: Jul. 10, 2012

(87) PCT Pub. No.: WO2011/061037
PCT Pub. Date: May 26, 2011

(65) Prior Publication Data

US 2012/0267126 A1 Oct. 25, 2012

(30) Foreign Application Priority Data

Nov. 18, 2009 (DE) ..... 10 2009 053 551

(51) Int. Cl.
*A62C 3/07* (2006.01)

(52) U.S. Cl.
CPC ..... *A62C 3/07* (2013.01)

(58) Field of Classification Search
CPC ..... A62C 3/07
USPC ..... 169/56, 60, 62, 55, 47, 46
See application file for complete search history.

(56) References Cited

U.S. PATENT DOCUMENTS 5,153,722 A * 10/1992 Goedeke et al. ..... 348/159
5,486,811 A * 1/1996 Wehrle ..... G08B 17/00 169/23
6,637,518 B1 * 10/2003 Hillier et al. ..... 169/46
(Continued)

FOREIGN PATENT DOCUMENTS

CN 201273381 7/2009 ..... F16K 5/06
EP 1419804 5/2004
(Continued)

OTHER PUBLICATIONS

International Searching Authority, International Search Report—International Application No. PCT/EP2010/065868, dated Jul. 22, 2010, together with the Written Opinion of the International Searching Authority, 10 pages.
(Continued)

*Primary Examiner* — Alexander M Valvis
*Assistant Examiner* — Christopher R Dandridge
(74) *Attorney, Agent, or Firm* — Sunstein Kann Murphy & Timbers LLP

(57) ABSTRACT

The invention relates to a fire fighting system, in particular for a railway vehicle, with a supply line for supplying at least one extinguishing nozzle with extinguishing fluid, wherein at least one section valve is arranged between the extinguishing nozzle and the supply line, wherein the section valve includes a signal processing means for controlling an adjustment means of the section valve, wherein the signal processing means can be electrically connected via a data communication network to a central control unit.

14 Claims, 1 Drawing Sheet

(56) References Cited

U.S. PATENT DOCUMENTS

| | | | | |
|---|---|---|---|---|
| 6,866,102 | B2 * | 3/2005 | Boyce | A62C 35/11 169/26 |
| 7,103,460 | B1 * | 9/2006 | Breed | 701/32.9 |
| 7,184,862 | B2 * | 2/2007 | Pillar et al. | 701/1 |
| 8,590,631 | B2 * | 11/2013 | Sprakel | A62C 3/07 169/23 |
| 2002/0117311 | A1 * | 8/2002 | Sundholm | A62C 3/07 169/56 |
| 2002/0174367 | A1 | 11/2002 | Kimmel et al. | 713/201 |
| 2006/0038029 | A1 | 2/2006 | Rummig et al. | 239/71 |
| 2006/0212194 | A1 * | 9/2006 | Breed | G07C 5/008 701/1 |
| 2007/0008099 | A1 | 1/2007 | Kimmel et al. | 340/506 |
| 2008/0064316 | A1 * | 3/2008 | Ng | A62C 3/08 454/76 |
| 2010/0207754 | A1 * | 8/2010 | Shostak et al. | 340/450 |
| 2012/0031634 | A1 * | 2/2012 | Lewinski et al. | 169/62 |

FOREIGN PATENT DOCUMENTS

| | | | |
|---|---|---|---|
| EP | 1500412 | 1/2005 | |
| JP | 07-116285 | 5/1995 | A62C 37/00 |
| JP | 07-222814 | 8/1995 | A62C 3/07 |
| JP | 07-006285 | 10/1995 | G08C 15/00 |
| KR | 10-2004-0099979 | 12/2004 | A62C 37/38 |
| KR | 20-0414051 | 4/2006 | A62C 3/07 |
| WO | WO 2004/082768 | 9/2004 | |
| WO | WO 2006/022489 | 3/2006 | |
| WO | WO 2006/111301 | 10/2006 | E04C 2/16 |
| WO | WO 2006/111361 | 10/2006 | |

OTHER PUBLICATIONS

Korean Patent Office, Korean Office Action, Korean Patent Application No. 10-2012-7015805, dated Jun. 21, 2013, 8 pages.

Korean Patent Office, English Translation—Korean Office Action, Korean Patent Application No. 10-2012-7015805, dated Jun. 21, 2013, 7 pages.

Japan Patent Office, English Translation—Japanese Office Action, Japanese Filing No. 2012-539254, dated Dec. 18, 2012, 2 pages.

Japan Patent Office, Japanese Office Action, Japanese Filing No. 2012-539254, dated Dec. 18, 2012, 3 pages.

Korean Patent Office, Korean Office Action, Korean Patent Application No. 10-2012-7015805, dated Jan. 17, 2014, 3 pages.

Korean Patent Office, English Translation—Korean Office Action, Korean Patent Application No. 10-2012-7015805, dated Jan. 17, 2014, 4 pages.

State Intellectual Property Office of Peoples Republic of China, Office Action, Application No. 201080059567.6, dated Apr. 10, 2014, 6 pages.

State Intellectual Property Office of Peoples Republic of China, English Translation—Office Action, Application No. 201080059567.6, dated Apr. 10, 2014, 8 pages.

The Korean Intellectual Property Office, Decision of Rejection, Application No. 10-2012-7015805, dated May 23, 2014, 3 pages.

The Korean Intellectual Property Office, English Translation—Decision of Rejection, Application No. 10-2012-7015805, dated May 23, 2014, 4 pages.

* cited by examiner

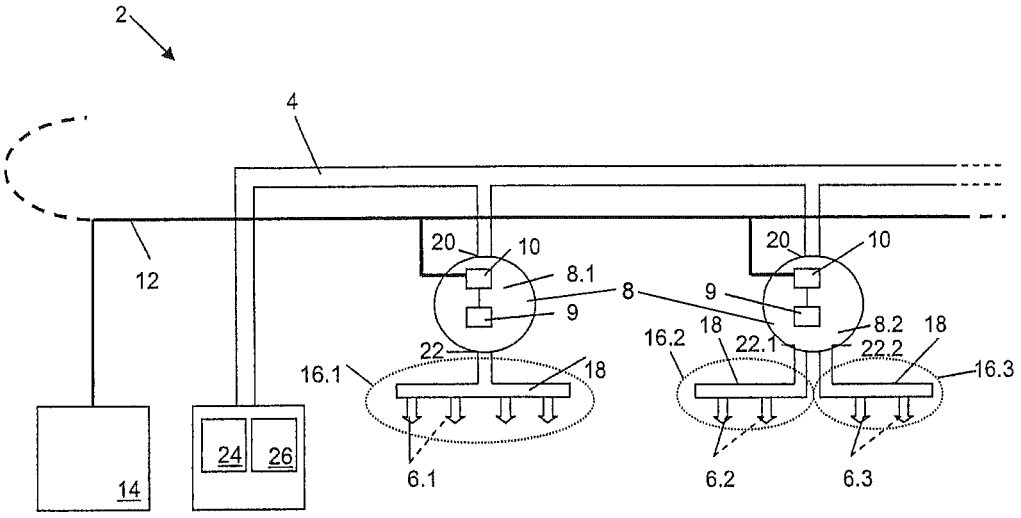
2
4
12
20
10
8.1
8
9
22
16.1
18
6.1
14
24
26
20
10
9
8.2
18
16.2
18
22.1
22.2
16.3
6.2
6.3

FIRE FIGHTING SYSTEM FOR A RAILWAY VEHICLE

The present invention relates to a fire fighting system, in particular for a railway vehicle with a supply line for supplying at least one extinguishing nozzle with extinguishing fluid, wherein at least one section valve is arranged between the extinguishing nozzle and the supply line. In addition the invention relates to a railway vehicle containing a fire fighting system and a method for operating a fire fighting system.

In railway traffic a constant concern is to improve the safety of the railway vehicles that are employed. A significant safety risk in this connection is the danger of fire in a railway vehicle. In order to avoid fires, in modern railway vehicles on the one hand materials are used that are fire resistant or at least poorly flammable. The danger of fire can however at best only be reduced in this way, since for example passengers can bring combustible articles onto the railway vehicles, and there is therefore a high risk of fire.

In order to deal with this problem, it is known from the prior art to install extinguishing nozzle arrangements in railway vehicles. For example, DE 10 2007 004 051 A1 and EP 1 757 330 A1 describe such fire fighting systems for railway vehicles. The fire fighting systems can include an extinguishing agent storage container, a pipeline system, extinguishing agent application means, such as for example extinguishing nozzles, and a pressure generation device. In the event of a fire the fire fighting system is activated and extinguishing agent, such as water, is applied preferably under a high pressure of 80 to 200 bar.

It has furthermore been shown that a railway vehicle can include various risk sections, such as for example the passenger compartment, toilet compartment, luggage area, engine compartment, etc. These individual sections of a railway vehicle can be subdivided by a plurality of section valves into corresponding sections, so that in the event of a fire an extinguishing fluid or extinguishing medium is applied only in the section in which the fire was detected. By means of a targeted application of the extinguishing fluid the amount of extinguishing fluid used can be reduced, so that the amounts of extinguishing fluid that have to be transported can be correspondingly optimised. In this way advantages can also be achieved as regards savings in weight and space.

According to the prior art magnetic valves are predominantly used as section valves. The use of electrically operated section valves is however also known. These section valves as a rule have one input and one output.

In the prior art the control of the section valves proves to be difficult and is associated in particular with a large effort and expenditure. As a rule each individual section valve has to be connected via a plurality of separate lines to a central control unit in order to be able to control the respective section valve from the central control unit. For example, with electrically operated section valves and magnetic valves a separate cable has to be laid for the two valve positions to be covered, and an electrical resistance is also integrated.

From WO 2006/100221 A1 a magnetic valve is known for example that can be controlled remotely. For this purpose the valve comprises an adjustment means in the form of an adjusting lever that is controlled through a central control unit.

The problem with this prior art however is that a large number of cables have to be laid. Thus, in addition to the adjustment means, limit switches, maintenance switches and an auxiliary drive also have to be provided, which in each case have to be remotely controlled from the central control unit via separate lines. A large installation effort and expenditure is thus associated with a remote maintenance and remote control of the fire fighting system according to the prior art.

From the aforedescribed disadvantages the object therefore arises of providing a fire fighting system for railway vehicles that allows a remote control of the section valves in a simple manner and with a low installation effort and expenditure.

This object is achieved according to one aspect by a fire fighting system, in particular for a railway vehicle, with a supply line for supplying at least one extinguishing nozzle with extinguishing fluid, wherein at least one section valve is arranged between the extinguishing nozzle and the supply line, in that the section valve comprises a signal processing means for controlling an adjustment means of the section valve, wherein the signal processing means can be electrically connected via a data communication network to a central control unit.

It had been recognised that a section valve can be controlled in a simple manner from a central control unit that may be located for example in the driver's cabin of the railway vehicle or at suitable checkpoints in the railway vehicle, if the section valve comprises a suitable signal processing means for controlling the adjustment means. As adjustment means a suitable means can be used, for example an adjusting lever, an electric motor or the like, so that the locking means of the section valve can be adjusted by the adjustment means.

The signal processing means can be integrated in the section valve or can also be arranged on the section valve via a suitable interface or the like. The signal processing means can be designed so that it can adjust via the adjustment means at least the valve position, and can therefore effect for example an opening and closing of the section valve.

The signal processing means also provides the advantage that it can be connected in a simple manner to a data communication network. A data communication network is as a rule already installed in the railway vehicle for other electrical equipment of the railway vehicle, such as for example an air conditioning unit, communication devices and the like. A complicated additional cable connection of the section valves to a central control unit via a large number of additional cables can therefore be avoided. It is simply necessary to connect the signal processing unit to the data communication network. It is however also possible according to the invention to use, for reasons of redundancy, a separate cabling arrangement for a fire alarm system and a control system.

As regards the energy supply, the signal processing means can have its own energy supply, such as a suitable energy storage device or the like, and/or can be coupled to the energy supply network of the railway vehicle. A user can then communicate via a central control unit and the data communication network preferably directly with the corresponding section valve.

The present fire fighting system for a railway vehicle allows in a simple manner a secure communication with at least one section valve. It is understood that, according to other variants of the present invention, the fire fighting system can also include two or more section valves as well as two or more extinguishing nozzles.

According to an advantageous embodiment it is proposed that the section valve is an electrically operated section valve. An electrically operated section valve comprises an electric motor as adjustment means, which can be operated for example via the signal processing means. The desired valve position can be adjusted with the electric motor. The use of an electrically operated section valve permits a particularly simple control of the section valve.

In order to provide a simple electrical connection of the signal processing means to the data communication network, according to a further advantageous exemplary embodiment it is proposed that the signal processing means can be connected via a data interface to the data communication network.

Moreover, the signal processing means can preferably include a processor, such as for example a microprocessor, a digital signal processor (DSP) or the like. A suitable signal processing means can be implemented, depending on the complexity of the section valve and the control of the adjustment means of the section valve.

In a further preferred exemplary embodiment the signal processing means can provide an IP address. Thus a simple addressing of the signal processing means and of the section valve respectively comprising the signal processing means is possible in this way. In particular known protocols can be employed for the communication between the central control unit and the signal processing means of a section valve. Such an addressing is possible in a simple manner specifically where there are a plurality of section valves.

Moreover the data communication network can preferably be formed as a token ring. A daisy chain network access is also possible. An Ethernet network access may furthermore be possible.

According to another advantageous exemplary embodiment it is proposed that the section valve for operating at least one extinguishing nozzle in a predeterminable first section of the railway vehicle is formed independently of at least one further extinguishing nozzle in a second predeterminable section of the railway vehicle. Different risk sections in a railway vehicle can be predetermined. If a fire is detected in one of these sections extinguishing fluid can then be applied independently of the other sections. For example, a first section may be the passenger compartment and a second section may be the toilet compartment of a railway vehicle. In principle the railway vehicle can be subdivided into any arbitrary number of sections. A third risk section would for example be a luggage area, engine compartment or the like. Due to the possibility of an independent control of the respective section in which a fire has been detected, the amount of extinguishing fluid required to control the fire can be reduced, so that savings in weight and space can be made. Suitable detectors can be employed to detect the fire.

In order to reduce the number of required section valves, according to a further preferred exemplary embodiment the section valve can comprise at least one inlet opening, a first outlet opening and a second outlet opening. By designing the section valve with at least two outlet openings, two different sections can be supplied independently of one another with extinguishing fluid using one section valve. For this purpose the section valve can comprise a corresponding locking means that can be actuated by the adjustment means. A further section valve is not necessary, in contrast to the prior art. This brings a significant saving as regards space and weight. For example, extinguishing nozzles in a first section of the railway vehicle can be supplied with extinguishing fluid from the supply line via the inlet opening and the first outlet opening, while extinguishing nozzles of a second section of the railway vehicle can be supplied with extinguishing fluid from the supply line via the inlet opening and the second outlet opening.

It is understood that only one outlet opening, both outlet openings or no outlet opening may be open. It is furthermore understood that the section valve can also comprise three or more outlet openings, in order to supply a third section and further sections of the railway vehicle independently of one another with extinguishing fluid. In particular, with two or more outlet openings the adjustment means of the section valve can be effectively controlled by the signal processing means. Furthermore, the installation effort and expenditure is also less, since despite a plurality of outlet openings only one connection of the signal processing means to the data communication network is necessary for a control and maintenance of the section valve.

According to a further exemplary embodiment the signal processing means can comprise data collecting means for determining the state of the section valve. The collected state data can then preferably be transmitted directly from the signal processing means via the data communication network to the central control unit. Depending on these state data the section valve and the adjustment means respectively can then be controlled with a high degree of precision in a simple manner. The collection of the state data can be carried out for example at periodic intervals. Also, it is possible for a user to access the data via the central control unit.

In principle all the data relating to the section valve can be recorded by the collecting means. According to a further exemplary embodiment the collecting means can be provided determining the operating mode of the section valve and/or the section valve positions and/or a section valve malfunction. For example, the collecting means can detect whether the section valve is in a maintenance mode, rest mode or operating mode. In the maintenance mode various tests can for example be carried out from the central control unit in order to test the functional capability of the section valve. For this purpose the various section valve positions, such as an open first outlet opening, an open second outlet opening, an open first and second outlet opening, etc., can for example be adjusted first of all. Suitable sensors can then detect whether the respectively adjusted valve position has actually been attained. If there is a malfunction of the section valve, such as for example a functional defect, then this can be detected immediately by the signal processing means and the information can be transmitted to the control unit and displayed there. Furthermore suitable steps can be taken by a user in order to rectify the malfunction. The data collecting means can include suitable sensors for recording these data.

It is understood that, according to other variants of the present invention, further data relating to the section valve can be collected. Thus, it is conceivable to record the ambient temperature, the section valve temperature, the flow rate through the section valve and the like, by means of suitable sensors. In addition to a simple maintenance possibility, in the event of a fire a simple control of the section valve can also be carried out.

Furthermore, the fire fighting system can according to a further exemplary embodiment comprise a pressure generation device, the said pressure generation device being able to be coupled to a compressed air supply of the railway vehicle. A desired rest pressure and/or operating pressure can be generated with the pressure generation device. Thus, the extinguishing fluid can be applied via the extinguishing nozzles at a high pressure, for example 80 to 200 bar. Due to a coupling of the pressure generation device to the compressed air supply of the railway vehicle, additional pressure generation units can be dispensed with.

The object mentioned above is achieved according to a further aspect by a railway vehicle comprising the aforedescribed fire fighting system. For example, the fire fighting system can be used in a high-speed train, a tram, an underground train, etc.

The object mentioned above is achieved according to a still further aspect by a method for operating a fire fighting system, in particular the fire fighting system described hereinbefore, in that a section valve arranged between a supply line and at least one extinguishing nozzle and comprising a signal processing means for controlling an adjustment means of the section valve, is controlled via a data communication network from a central control unit. In particular the section valve can be controlled through the central control unit directly via the arranged signal processing means. The fire fighting system, in particular the section valves of the fire fighting system, can be operated in a simple manner.

The invention is described in more detail hereinafter with the aid of a drawing showing exemplary embodiments. In the drawing the single FIG. 1 shows a first exemplary embodiment of a fire fighting system.

FIG. 1 shows a fire fighting system 2 with an extinguishing means storage container 24, a pressure generation device 26, a supply line 4, section valves 8, section lines 18 and extinguishing nozzles 6.1, 6.2, 6.3. In this connection the pressure generation device 26 can preferably be coupled to the compressed air supply of the railway vehicle (not shown).

It can furthermore be seen that a central control unit 14 and a data communication network 12 are provided. The central control unit 14 can comprise a suitable processor, input and output means, etc. The data communication network 12 can preferably be formed as a token ring, which is indicated by the dotted line. It is understood however that other configurations of the data communication network 12 are also possible.

The fire fighting system can preferably be used in the railway vehicle, wherein a data communication network is already preferably installed in the railway vehicle. In this connection the railway vehicle can be subdivided into different risk sections 16.1, 16.2 and 16.3. For example, the first section 16.1 can be the passenger compartment, the second section 16.2 can be the toilet compartment and the third section 16.3 can be a luggage area. It is understood that also more than or only two sections can be provided.

The supply of the first section 16.1 with extinguishing fluid from the extinguishing fluid storage container 24 via the supply line 4 can take place via a first section valve 8.1.

Preferably the first section valve 8.1 is an electrically operated valve 8.1 with an adjustment means 9 in the form of an electric motor 9 for adjusting the locking means (not shown).

The electric motor 9 can in this connection be operated via a signal processing means 10. The signal processing means can be integrated in the section valve 8.1 or can be arranged on the latter. The section valve 8.1 furthermore comprises an inlet opening 20 and an outlet opening 22.

In the first section 16.1 a plurality of extinguishing nozzles 6.1 can be arranged that can communicate via a section line 18 with the outlet opening 22 of the section valve 8.1. For reasons of clarity the representation of fire detection devices for detecting a fire in the first section was omitted.

The supply of the extinguishing nozzles 6.2 in the second section 16.2 of the railway vehicle with extinguishing fluid and the supply of the extinguishing nozzles 6.3 in the third section 16.3 of the railway vehicle with extinguishing fluid is implemented via a second section valve 8.2. Preferably this section valve 8.2, like the first section valve 8.1, is designed as an electrically operated section valve 8.2 with a signal processing means 10 for controlling an electric motor 9.

Compared to the section valve 8.1, the section valve 8.2 has however a first outlet opening 22.1 and a second outlet opening 22.2. Thus, the extinguishing nozzles 6.2 of the second section 16.2 can be supplied with extinguishing fluid via the first outlet opening 22.1 of the section valve 8.2, while the extinguishing nozzles 6.3 of the third section 16.3 can be supplied with extinguishing fluid via the second outlet opening 22.2 of the section valve 8.2.

Furthermore it can be seen from FIG. 1 that the signal processing means 10 are connected to the central control unit 14 via the data communication network 12. For this purpose the signal processing means 10 can include suitable data interfaces.

As has already been stated hereinbefore, the signal processing means 10 can be integrated into the section valves 8. Similarly, it is possible for the signal processing means 10 to be arranged via a suitable interface or the like on the section valves 8. Due to the arrangement of the signal processing means 10, which may preferably include a suitable processor, at the section valves 8 a simple control of the respective section valve 8 and of the corresponding adjustment means 9 respectively is made possible via the central control unit 14.

In addition the signal processing means 10 may comprise data collecting means, such as for example suitable sensors, in order to collect state data of the section valve 8. For example, the operating mode of the section valve 8, a malfunction of the section valve 8, the section valve position, the temperature of the section valve 8, the flow rate through the section valve 8 and similar state parameters relating to the respective section valve 8, can be recorded.

Furthermore the signal processing means 10 can be connected to fire detection devices in order to be able to detect a fire and/or transmit the corresponding data to the central control unit 14. It is understood that, alternatively and additionally, further fire detectors can be provided.

If a fire is now detected by suitable fire detectors in a first section 16.1, then the fire fighting system 2 in the first section 16.1 is preferably automatically activated. For example, the outlet opening 22 of the section valve 8.1 is opened, so that extinguishing fluid can flow out, preferably under high pressure, through the extinguishing nozzles 6.1. For this purpose the signal processing means 10 can appropriately trigger the adjustment means 9, so that the locking means are adjusted to the valve opening position. It is understood that, apart from the section valves 8, further valve devices can be provided in the line system.

The respective signal processing means 10 can transmit the change in the state of the section valve 8.1 directly to the central control unit 14. A user of the central control unit 14, such as for example the train driver, can if necessary take further suitable action, such as operating the braking system of the railway vehicle.

In the case where a fire is detected in the third section 16.3, the second outlet opening 22.2 of the section valve 8.2 can be opened by the signal processing means 10.2 by means of the adjustment means 9 and the locking means, while the first outlet opening 22.1 of the section valve 8.2 remains closed. In this case too the signal processing means 10.2 can then transmit the altered state data to the central control unit 14.

With simply one section valve it is possible in a simple manner to supply at least two different sections with extinguishing fluid independently of one another.

Apart from the simple control of the section valves 8 in the event of a fire, the present fire fighting system 2 also allows a simple central maintenance of the section valves 8. A user can carry out various tests centrally from the central control unit 14 in order to check the functionality of the individual section valves 8. Thus, the individual valve positions, such as open first outlet opening, open second outlet opening, etc., can be adjusted via the central control unit 14. It can then be detected via the data collecting means of the signal processing means 10 whether the desired valve position has also actually been attained. A manual check of each individual section valve 8 is not necessary.

The invention claimed is:

1. A fire fighting system installed in a railway vehicle, the fire fighting system comprising:

a supply line for supplying at least one extinguishing nozzle with extinguishing fluid;

at least one section valve arranged between the at least one extinguishing nozzle and the supply line, wherein each of the at least one section valve includes a signal processing unit integrated in the section valve and having a processor for controlling an adjustment unit of the section valve, wherein the signal processing unit is electrically connected via a data communication network to a central control unit, the signal processing unit being configured to transmit and receive data via the data communication network.

2. The fire fighting system of claim 1, wherein the section valve is an electrically operated section valve.

3. The fire fighting system of claim 1, wherein the signal processing unit is connected via a data interface to the data communication network.

4. The fire fighting system of claim 1, wherein the signal processing unit comprises an IP address.

5. The fire fighting system of claim 1, wherein the data communication network is formed as a token ring.

6. The fire fighting system of claim 1, wherein the section valve is designed to operate at least one extinguishing nozzle in a predeterminable first section of a railway train vehicle independently of at least one further extinguishing nozzle in at least one second predeterminable section of the railway train vehicle.

7. The fire fighting system of claim 1, wherein the section valve comprises at least one inlet opening, a first outlet opening and at least one second outlet opening.

8. The fire fighting system of claim 1, wherein the signal processing unit comprises data collecting unit for recording the state of the section valve.

9. The fire fighting system of claim 8, wherein the data collecting unit is provided for determining the operating mode of the section valve and/or the section valve position and/or a section valve malfunction.

10. The fire fighting system of claim 1, wherein the fire fighting system comprises a pressure generation device, wherein the pressure generation device is coupled to a compressed air supply of the railway train vehicle.

11. A railway train vehicle comprising the fire fighting system of claim 1.

12. A method for operating a fire fighting system installed in a railway vehicle, wherein a section valve is arranged between a supply line and at least one extinguishing nozzle and comprises a signal processing unit having a processor, for controlling an adjustment unit of the section valve, that is controlled via a data communication network from a central control unit, wherein the signal processing unit is integrated in the at least one section valve and further including recording the state of the section valve in a data collecting unit in the signal processing unit.

13. A fire fighting system installed in a railway vehicle, the fire fighting system comprising:

a supply line for supplying at least one extinguishing nozzle with extinguishing fluid;

at least one section valve arranged between the at least one extinguishing nozzle and the supply line, wherein each of the at least one section valve includes a signal processing unit integrated in the section valve and having a processor for controlling an adjustment unit of the section valve, wherein the signal processing unit is electrically connected via a data communication network to a central control unit and the signal processing unit further comprises a data collecting unit for recording the state of the section valve.

14. The fire fighting system of claim 13, wherein the data collecting unit is provided for determining the operating mode of the section valve and/or the section valve position and/or a section valve malfunction.

* * * * *